US007475781B2

(12) United States Patent
Kobayashi et al.

(10) Patent No.: US 7,475,781 B2
(45) Date of Patent: Jan. 13, 2009

(54) EASY-OPEN PACKAGE

(75) Inventors: Shinichiro Kobayashi, Kagawa (JP); Ikuya Saito, Kagawa (JP); Sachi Sugiura, Kagawa (JP)

(73) Assignee: Uni-Charm Corporation, Ehime-Ken (JP)

( * ) Notice: Subject to any disclaimer, the term of this patent is extended or adjusted under 35 U.S.C. 154(b) by 453 days.

(21) Appl. No.: 11/155,320

(22) Filed: Jun. 16, 2005

(65) Prior Publication Data

US 2005/0284776 A1 Dec. 29, 2005

(30) Foreign Application Priority Data

Jun. 23, 2004 (JP) ..... 2004-185542

(51) Int. Cl.
*B65D 33/16* (2006.01)
*B65D 73/00* (2006.01)

(52) U.S. Cl. ..... 206/494; 206/233; 206/812; 383/66; 383/203

(58) Field of Classification Search ..... 206/494, 206/233, 484, 812, 449, 210; 383/203, 207, 383/210, 210.1, 211, 66; 220/255.1
See application file for complete search history.

(56) References Cited

U.S. PATENT DOCUMENTS 4,552,269 A * 11/1985 Chang ..... 383/211
4,800,110 A * 1/1989 DuCorday ..... 428/43
5,725,311 A * 3/1998 Ponsi et al. ..... 383/66
5,908,246 A 6/1999 Arimura et al.
6,113,271 A * 9/2000 Scott et al. ..... 206/494
6,126,009 A 10/2000 Shiffler et al.
6,309,105 B1 * 10/2001 Palumbo ..... 383/211

FOREIGN PATENT DOCUMENTS

| | | | |
|---|---|---|---|
| EP | 1609737 | A2 * | 12/2005 |
| JP | 59-99974 | U | 7/1984 |
| JP | 7-15581 | U | 3/1995 |
| JP | 10-017037 | A | 1/1998 |
| JP | 10-053286 | A | 2/1998 |
| JP | 10-167355 | A | 6/1998 |
| JP | 11-020874 | A | 1/1999 |
| JP | 11-268783 | A | 10/1999 |
| JP | 11-310281 | A | 11/1999 |
| JP | 11-314686 | A | 11/1999 |
| JP | 2005255218 | A * | 9/2005 |

OTHER PUBLICATIONS

European Search Report for EP 05 25 3455 (Date of Completion: Nov. 9, 2005).

* cited by examiner

*Primary Examiner*—J. Gregory Pickett
(74) *Attorney, Agent, or Firm*—Darby & Darby

(57) ABSTRACT

A package is presented from which contents can be easily taken out. This package includes a film with a soft packaging material. On the surface of the soft packaging material is a cut line, such that, inside the cut line, an openable region is formed for taking contents out from the package. Further, inside the openable region, dashed lines are provided. When a lid member adhering to cover the openable region is peeled, the openable region easily adheres to the lid member side owing to the dashed lines to reliably form the opened portion.

11 Claims, 7 Drawing Sheets

EASY-OPEN PACKAGE

CROSS-REFERENCE TO RELATED APPLICATIONS

This application is based upon and claims the benefit of priority from Japanese Patent application No. 2004-185542 filed on Jun. 23, 2004, the entire contents of which is incorporated herein by reference.

FIELD OF THE INVENTION

The present invention relates to a package for the easy takeout of contents stored therein.

RELATED ART

Conventionally, for example, as a package storing moist contents such as wet tissues, a portable package has been investigated which is easy for taking contents out and also able to be re-sealed to prevent the remained contents from drying for the reuse thereof.

As such a package, for example, in the patent reference 1 cited below has been described an enclosing bag made of cosmetic cellulose in which an opened portion is made by forming a cut on the bag main body, and a lid member which can be peeled is provided to cover the cut using an adhesive, disclosing a film packaging material having an opened portion which can be resealed.

In FIG. 14 is shown an example of such a conventional package. As shown in FIG. 14, this package 300 is a pillow-shaped package made of a film 310 comprising a soft packaging material, and a backside of the package in FIG. 14, has a sticker (not shown).

On the upper surface side of the film 310 in FIG. 14, the cut line 311 in the C letter shape is provided to form the openable region 350. And, the lid member 320 having a tongue piece part 321 adheres to cover this openable region 350, and an adhesive layer is provided on the inner surface of the lid member 320.

In this package 300, when the lid member 320 is peeled from the tongue piece part 321 side, the openable region 350 is cut off along the cut line 311 and lifted with the adhesive layer on the backside of the lid member 320 to be separated together with the lid member 320 as one body. The region surrounded by the cut line 311 thereby becomes an opened portion for taking out contents.

[Patent reference 1] Publication of unexamined utility model applications No. Sho-59-99974 (1984-99974)

SUMMARY OF THE INVENTION

In the case of the conventional package 300 as shown in FIG. 14, for example, when an adhesiveness of the adhesive layer is reduced to facilitate the peeling of the lid member 320, the openable region 350 is not successfully cut off from the cut line 311, left behind without adhering to the lid member 320 side, posing, as a result, a problem that the opened portion is not formed sometimes. Further, such a phenomenon is a problem also posed in other cases when the formation of the cut line 311 is incomplete, and when the rigidity of the film 310 is high.

The present invention has been made in view of the above-described problems, aiming at providing a package capable of stably forming the opened portion even when the film rigidity of packaging material is high and when adhesiveness of the lid member is lowered.

More specifically, this invention provides an easy-open package constituted as follows.

(1) An easy-open package comprising a filmy soft packaging material and contents packaged by the packaging material, wherein, the soft packaging material is provided with a cut line so as to form an openable region for taking the contents out of the easy-open package, a lid member which can be peeled from the soft packaging material adheres to the surface of the soft packaging material to cover the openable region, and a weakened portion is provided within the openable region of the soft packaging material formed by means of weakening processing.

According to the easy-open package of this invention, rigidity of the soft packaging material of the openable region can be substantially lowered by a weakened portion provided within the openable region. Accordingly, when the lid member is peeled, the openable region follows the lid member side to easily adhere thereto, and can be reliably cut off along the cut line to surely form the opened portion.

Further, the "weakened portion" formed by the weakening processing may be, for example, a linear dashed line such as a continuous line and a perforation formed by a punch cutting die or laser processing. Further, the weakened portion is not limited to dashed line, but may be, for example, microscopic wound-like asperity formed on a partial or an entire film surface of the openable region made by processing with an emboss part attached with diamond pieces on its surface.

In this case, the filmy soft packaging material in this invention refers to packaging materials in general comprising plastic film, paper, non-woven fabric and laminates thereof, preferably to a laminated film provided with a heat-sealed layer as an innermost layer and a base material layer drawn in at least one direction as an outer layer, but will not be limited to this.

"Openable region" formed by the cut line is to provide an opened portion allowing the takeout of contents when unsealing the package. Therefore, the cut line may be, for example, drawn in the shape of substantially closed rectangular, which is to become the opened portion. It may be also non-closed line like a C letter shape, which leads to opening. The cut line may be a continuous line, or perforations.

(2) The easy-open package according to (1), wherein the weakened portion is a dashed line.

With this mode, the weakened portion can be easily formed by making the dashed line to be a weakened portion. That is, since this dashed line can be formed simultaneously with the above-described cut line using a punch cutting die processing, the weakened portion can be formed without additional special processes.

The dashed line may be a continuous line or perforations. Cuts of the dashed line may be formed also to pierce the soft packaging material, or in a so-called "half cut" state in which the cuts of dashed line do not go through the soft packaging material in its thickness direction. However, from the aspect of reducing rigidity of soft packaging material, the cuts of the dashed line are preferably formed so as to pierce the soft packaging material.

(3) The easy-open package according to (2), wherein the dashed line is formed perpendicular to the peeling direction along with the lid member is peeled.

With this mode, since the dashed line part in the openable region is made weak, the openable region is folded along the dashed line when the lid member is peeled along the peeling direction. The openable region thereby easily adheres to the lid member so as to enable to reliably provide the opened portion. In this case, a "peeling direction" means the peeling direction when the lid member is folded back making a 180 degree turn.

(4) The easy-open package according to (2) or (3), wherein the dashed line is formed in a curve shape or a V letter shape protruding to the peeling direction of the lid member.

With this mode, by protruding the dashed line to the peeling direction of lid member, the erroneous formation of a not-intended small opened portion lead by the dashed line can be prevented. That is, when the dashed line is formed protruding to the opposite direction to that of the lid member peeling, the soft packaging material is cut off not in the region corresponding to the original opened portion but along the dashed line in the inner side thereof by the cut line, likely to cause a risk to form a not-intended small opened portion inside the region of the proper predetermined opened portion.

With this mode, the dashed line has been protruded to the peeling direction of the lid member so as to exist only for reducing rigidity of the soft packaging material in the openable region. Thus, the soft packaging material is prevented from being cut along the dashed line so as to make the opened portion to become small.

In this case, "protruding" to the peeling direction means that the dashed line may curve toward the peeling direction side, including not only in the shape of V letter but also in a slow arc shape (5) The easy-open package according to any one of (2) through (4), wherein the dashed line is provided in a plurality thereof with predetermined intervals between them.

With this mode, since a plurality of dashed lines are provided with predetermined intervals, rigidity of the openable region of the soft packaging material can be further reduced so as to enable to reliably provide the opened portion.

According to the present invention, for example, for a package holding contents such as wet tissues, it is possible to provide a package capable of stably forming the opened portion even when the film rigidity of packaging material is high, and when the adhesion strength of the lid member is reduced.

DESCRIPTION ON THE PREFERRED EMBODIMENT

In the following, one embodiment of this invention will be explained with reference to the drawings. In the description of the following embodiment, the same constitutive elements are denoted by identical symbols, and the description thereof is omitted or simplified.

First Embodiment

<Overall Constitution of Easy-Open Package>

Figure 1:
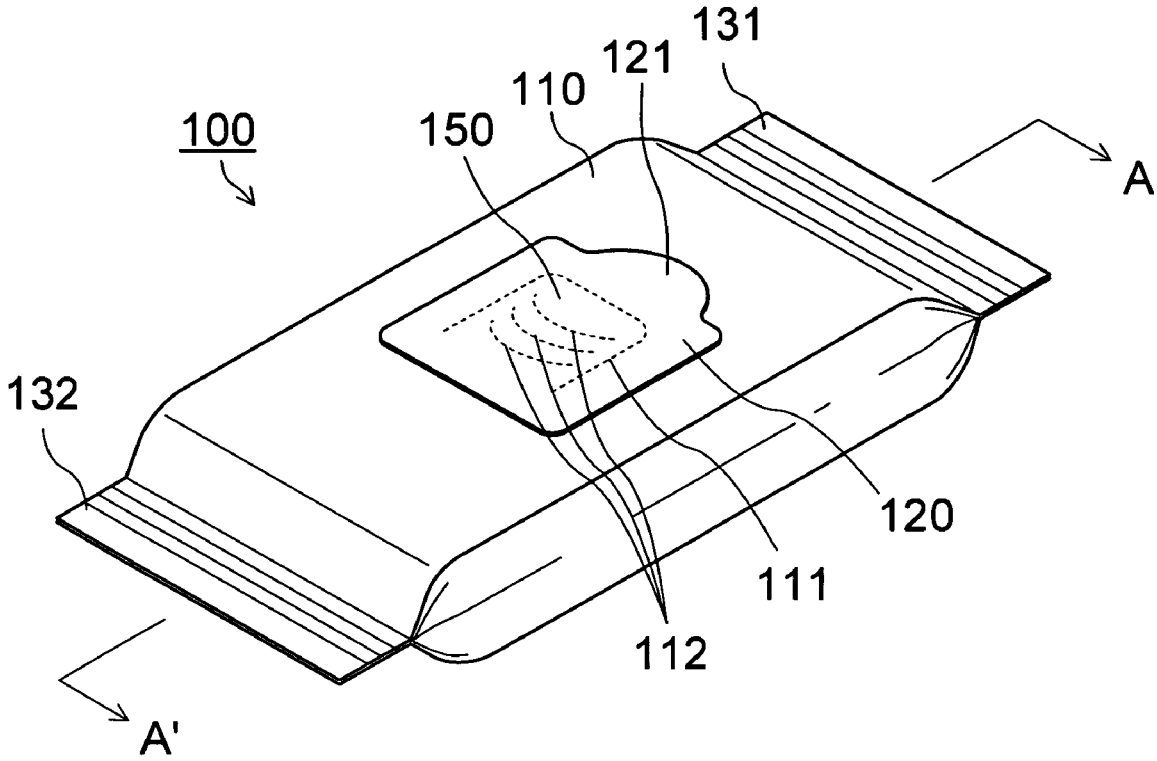
FIG. 1 is a perspective view representing a package according to a first embodiment of this invention.
Figure 2:
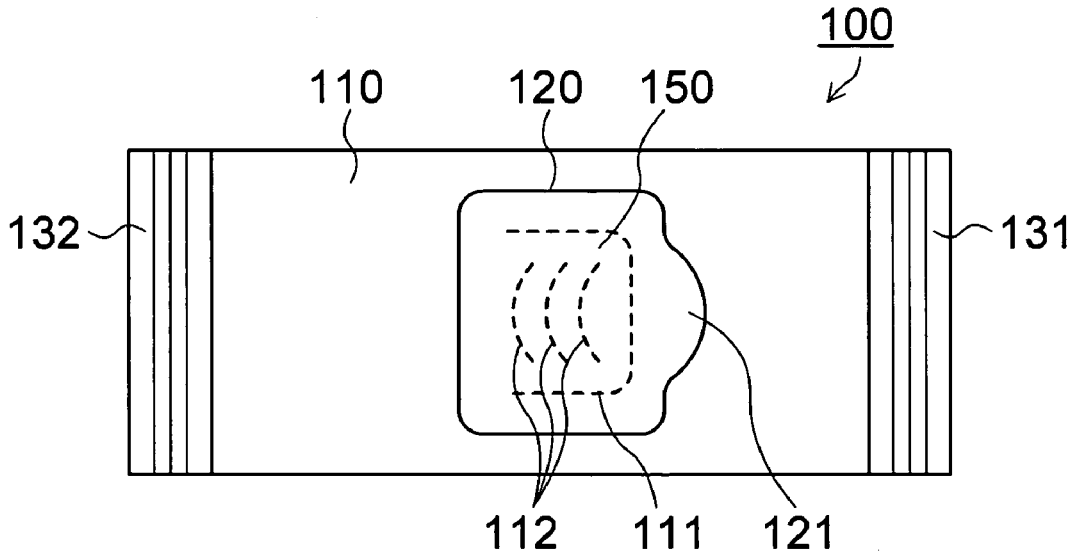
FIG. 2 is a plan view of the package shown in FIG. 1.
Figure 3:
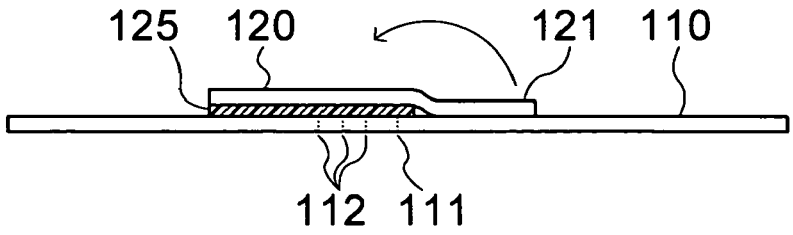
FIG. 3 is an enlarged cross-sectional view of the package along the A-A' line in FIG. 1.

FIGS. 1 through 3 are drawings showing the first embodiment of the easy-open package of this invention, FIG. 1 representing a perspective diagram of the easy-open package; FIG. 2 being a plan view of FIG. 1; and FIG. 3 being an enlarged A-A' cross-sectional view of FIG. 1.

As shown in FIG. 1, this package 100 is a pillow-shaped package constituted of a film 110 comprising a soft packaging material. In FIG. 1, 131 and 132 are an upper and lower lateral side of sticker parts respectively. And a longitudinal sicker (backside sticker) part is on a central part of a back surface side in FIG. 1 which is not illustrated. At a central part of an upper surface of the package 100, a lid member 120 having a tongue piece 121 is provided.

<Constitution of Film Comprised Soft Packaging Material>

The film 110 constituting the package 100 may be a single-layered film or laminated film, but is preferably a laminated film from the aspect of possibility of a heat-sealing. As a constitution of the laminated film, the conventional constitutions known in the art can be used without particular limitations. For example, starting from the outer surface, constitutions such as base material layer/heat seal layer; base material layer/middle layer/heat seal layer; and base material layer/first middle layer/second middle layer/heat seal layer can be cited. The laminating method may be a dry laminating method through the intermediary of adhesive, or the extrusion coating method using polyethylene and polypropylene.

The base material layer (outermost layer) is exemplified by those composed of stretched polyester, stretched polyamide, stretched polypropylene, etc. The middle layer is exemplified by those composed of aluminum foil, stretched polyester, stretched polyamide, stretched polypropylene, etc. And the heat seal layer is exemplified by those composed of polyethylene, polypropylene, ethylene-vinyl acetate copolymer, ionomer, etc.

A specific example of such a film 310 is a laminated film comprising a biaxial stretching polyester (PET) 12 μ/aluminum foil (AL) 7 μ/cast polypropylene (CPP) 30 μ.

<Cut Line and Openable Region>

On the upper surface of the film 110 of the package 100 is formed, as shown in FIGS. 1 and 2, the cut line 111 in the C letter shape. And, by this C letter shaped cut line 111, the openable region 150 is formed inside thereof. This openable region 150 will become a part to be cut upward by peeling the lid member 120 later.

The cut line 111 may be provided so as to form the openable region 150, and is not particularly limited in its shape and length. Further, the size of the openable region 150 which is to be a mouth of the package can be appropriately selected according to the size of the package 100, and the size as well as shape of contents to be taken out. For example, in the case of portable wet tissues as the contents, the size of the openable region 150 is preferably in the range of 5×20 mm to 40×60 mm.

Further, although, in this embodiment, the cut line 111 is a continuous line, whose cut pierces the film 110, it may be not always a continuous line but formed in the form of a perforation. The openable region 150 may be an unclosed region as in this embodiment or a closed region.

<Dashed Line>

In the inside area surrounded by the C letter-shaped cut line 111, 3 parallel dashed lines 112 are provided in the direction perpendicular to the peeling direction of the lid member 120, that is, the direction parallel to the lateral side sticker parts 131 and 132 in FIG. 1. And, the respective dashed lines 112 are shaped in an arc protruding to the peeling direction of the lid member 120, that is, the direction opposite to the tongue piece part 121 of the lid member 120 (the direction of the lateral side sticker part 132 in FIG. 1).

In this invention, rigidity of the film 110 at the openable region 150 can be reduced by these dashed lines 112. The openable region 150 thereby becomes easily bendable so as to be readily cut off from the cut line 111, assuring the adhesion of the lid material 120 to the adhesive layer 125 side.

Thus, it is sufficient for the dashed lines 112 to be formed such that the openable region 150 becomes easily bendable, and their shapes, lengths and numbers can be appropriately set up, the shape thereof not being limited to the arc as in. FIG. 1. The dashed lines 112 may be zigzag and wavy, or in combination of different shaped lines.

FIGS. 4 through 8 represent preferable examples of the dashed line 112. That is, the dashed line in this invention may have an arc form as shown in the dashed lines 112 of FIG. 4, a linear form as shown in the dashed lines 113 of FIG. 5, a V letter form as shown in the dashed lines 114 of FIG. 6, a single arc as shown in the dashed line 115 of FIG. 7, and a perforation but not a continuous line as shown in the dashed line 116 of FIG. 8.

In this case, to make the openable region 150 easily bendable along the peeling direction when the lid member 120 is peeled, as shown in the above-described FIGS. 4 through 8, the dashed lines 112 through 116 may be preferably formed perpendicularly to the peeling direction (direction of the arrow sign in FIG. 9) when the lid member 120 is 180 degree folded back.

Figure 4:
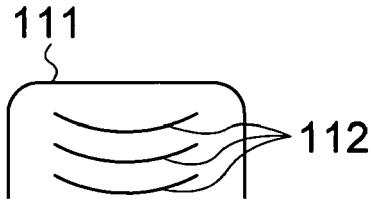
FIG. 4 is an enlarged plan view of the dashed lines shown in FIG. 1.
Figure 5:
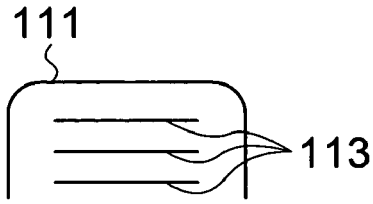
FIG. 5 is a plan view showing the other example of the dashed lines.
Figure 6:
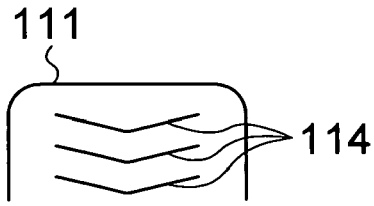
FIG. 6 is a plan view showing the other example of the dashed lines.

Further, as shown in FIGS. 4 and 6, by forming the dashed lines 112 and 114 in the arc shape or V letter shape protruding to the peeling direction of the lid member 120, it is possible to prevent the erroneous formation of a not-intended small opened portion which may be caused by the dashed lines.

Figure 7:
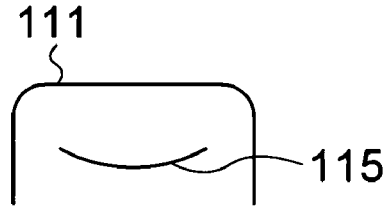
FIG. 7 is a plan view showing the other example of the dashed line.
Figure 8:
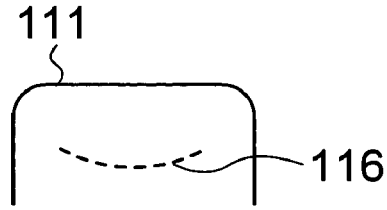
FIG. 8 is a plan view showing the other example of the dashed line.

Further, like the dashed line 115 of FIG. 7, at least a single dashed line may be sufficient, and the number thereof can be appropriately set depending on rigidity of the film 110.

Further, although the cut of the dashed line may be formed so as to pierce the soft packaging material or in a so-called half-cut state, it is preferably formed so as to pierce the film 110 from the aspect of reducing the rigidity of the film to make it easily bendable. In this case, the half-cut dashed line can be formed, for example, by the methods known in the art such as those by laser irradiation and mechanical processing like punch cutting die cutters.

<Lid Member>

As shown in FIGS. 1 through 3, the lid member 120 having the tongue piece part 121 adheres so as to cover the openable region 150. And, as shown in FIG. 3, the adhesive layer 125 is provided in the part of the undersurface of the lid member 120 excluding the tongue piece part 121. By way of this adhesive layer 125, the lid material 120 adheres to the film 110 in a detachable manner. Herein, "to adhere" means a state in which the lid member 120 can be re-peeled and re-sealed.

As the lid member 120, a sheet-like material having a predetermined rigidity is preferable, for example, a laminated film comprising oriented polypropylene (OPP) 20 μm/polyethylene terephthalate (PET) 70 μm can be cited. Further, the adhesive layer 125 can be formed by using a common hot-melt adhesive.

<Function>

Figure 9:
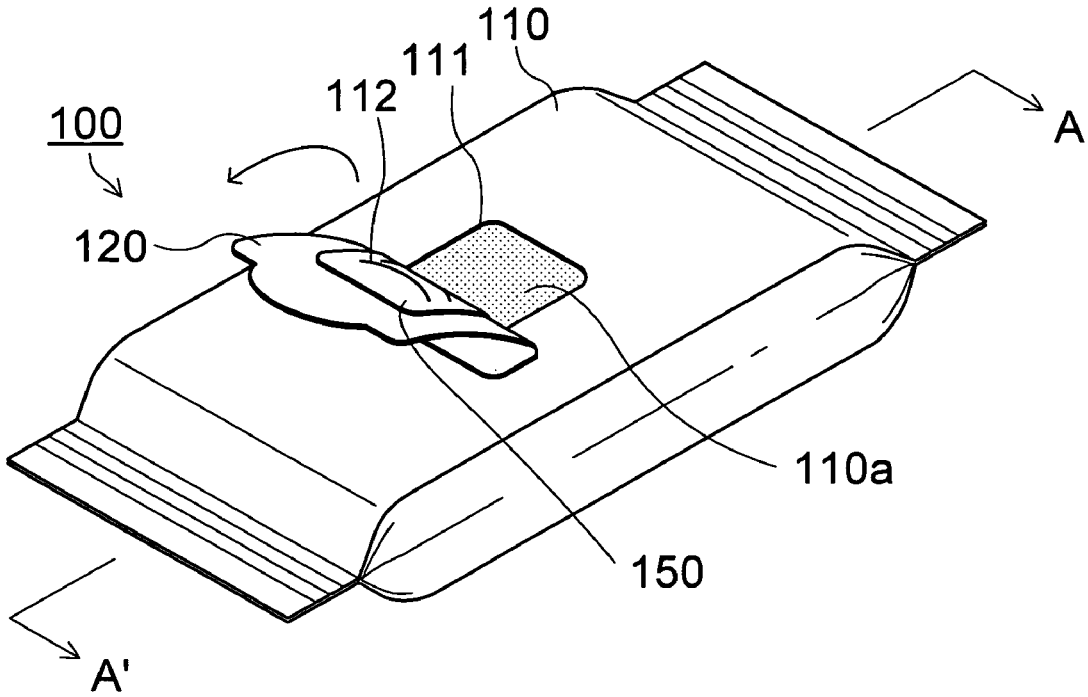
FIG. 9 is a perspective view representing a state in which the lid member is peeled in FIG. 1.
Figure 10:
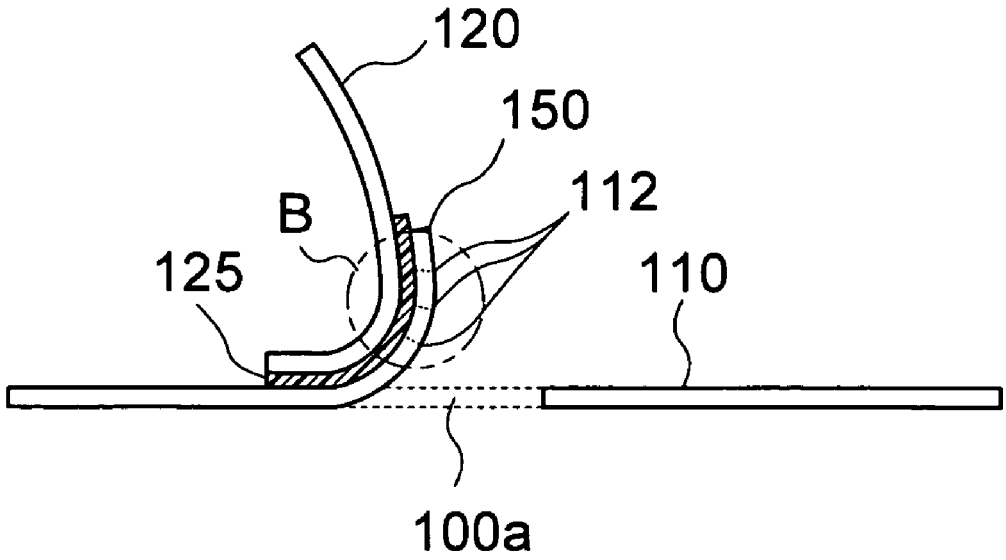
FIG. 10 is an enlarged cross-sectional view of the package along A-A' line shown in FIG. 9.
Figure 11:
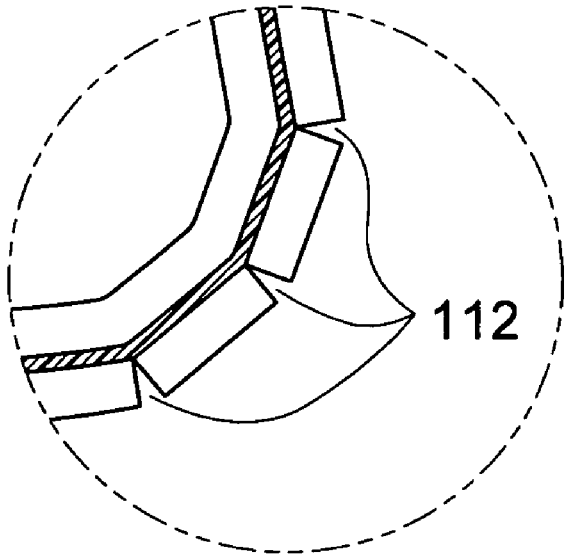
FIG. 11 is a partial enlarged cross-sectional view of the B part near the dashed lines in FIG. 10.

Next, with reference to FIG. 9 through FIG. 11, the function of this package 100 will be explained. FIG. 9 is a perspective view showing the state in which the lid member 120 in FIG. 1 has been peeled; FIG. 10 an enlarged cross sectional view along the A-A' line in FIG. 9; and FIG. 11 a partial enlarged view of the vicinity B of the dashed lines in FIG. 10.

First, as shown in FIGS. 9 and 10, in the package 100, the lid member 120 is peeled from the tongue piece part 121 thereof along the direction of the arrow sign. Then, the openable region 150 adheres by the adhesive layer 125 to the back surface side of the lid member 120, and the openable region 150 of the film 110 is cut off along the cut line 111 to be lifted. Thus, the opened portion 110*a* is formed on the upper surface of the film 110 such that contents become visible to be easily taken out from this opened portion 110*a*.

In this case, in this embodiment, with these three dashed lines 112, rigidity of the film 110 of the openable region 150 can be reduced. That is, as shown in a partial enlarged view of FIG. 11, by the dashed lines 112, the openable region 113 of the film 110 becomes stepwise bended. Thus, it becomes easy to cut off the film 110 from the cut line 111 and makes the lid member 120 to adhere to the adhesive (tacky) layer 125, such that the opened portion 110*a* can be reliably formed.

To re-seal the lid member 120 after unsealing, the adhesive (tacky) layer 125 remaining around the openable region 150 on the back surface side of the lid member 120 enables the re-sealing. And, also in this case, the rigidity of the film 110 of the openable region 150 reduced by the dashed lines 112 has advantage of performing the easy re-sealing.

Further, in this invention, the lid member 120 may not necessarily be for re-sealing, and, for example, in FIG. 9, the film 110 may be torn up to the lateral side sticker part 132 so as to form a larger opened portion.

Second Embodiment

<Constitution>

Figure 12:
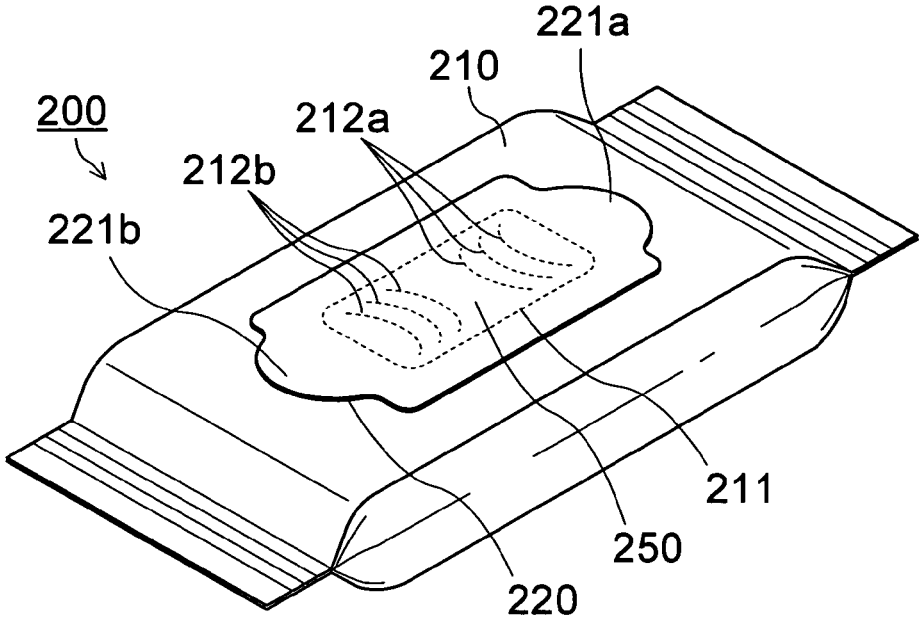
FIG. 12 is a perspective view representing a package according to a second embodiment of this invention.
Figure 13:
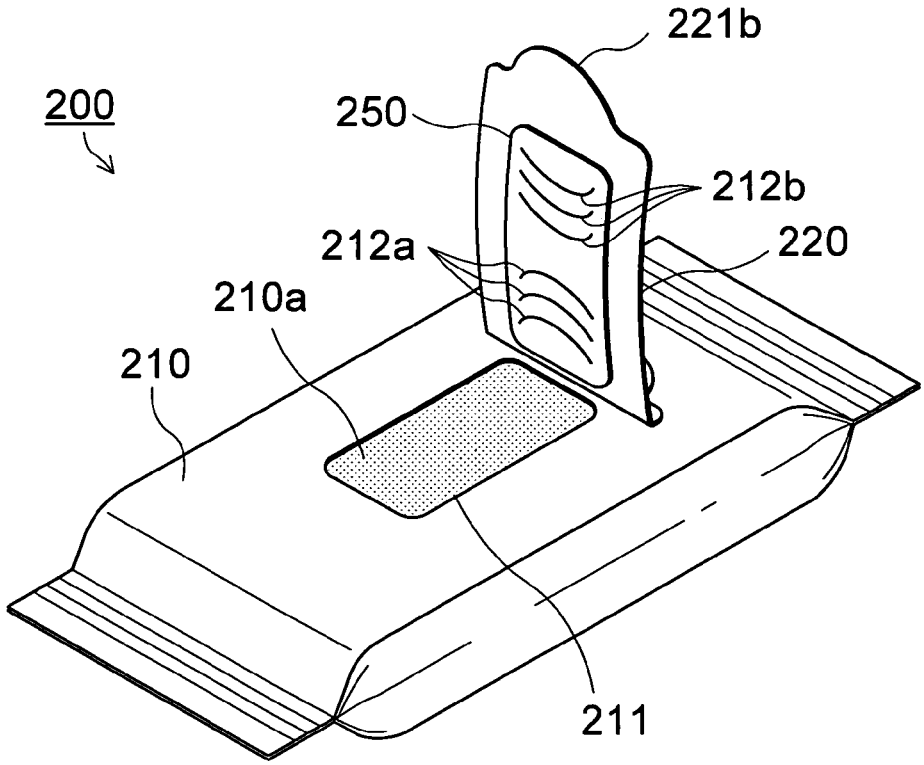
FIG. 13 is a perspective view representing a state in which the lid member is peeled in FIG. 12.
Figure 14:
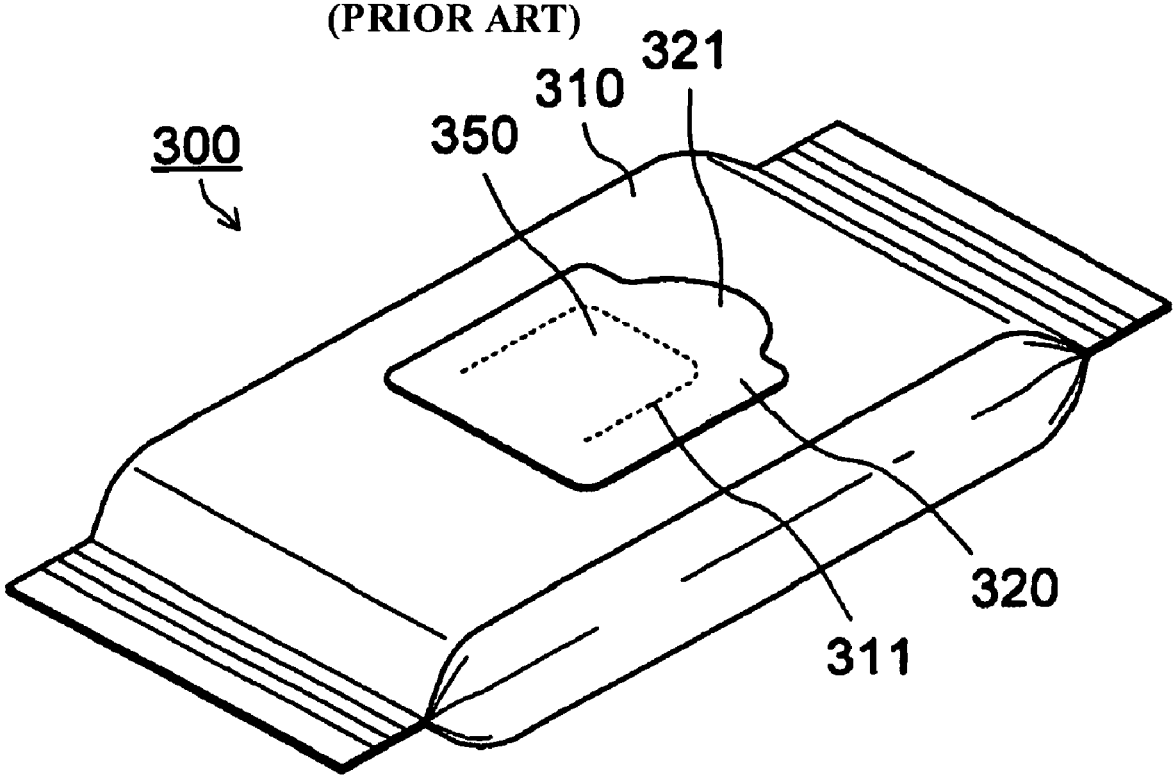
Fig. 14 (PRIOR ART)
FIG. 14 is a perspective view representing an example of the conventional package.
Figure 15:
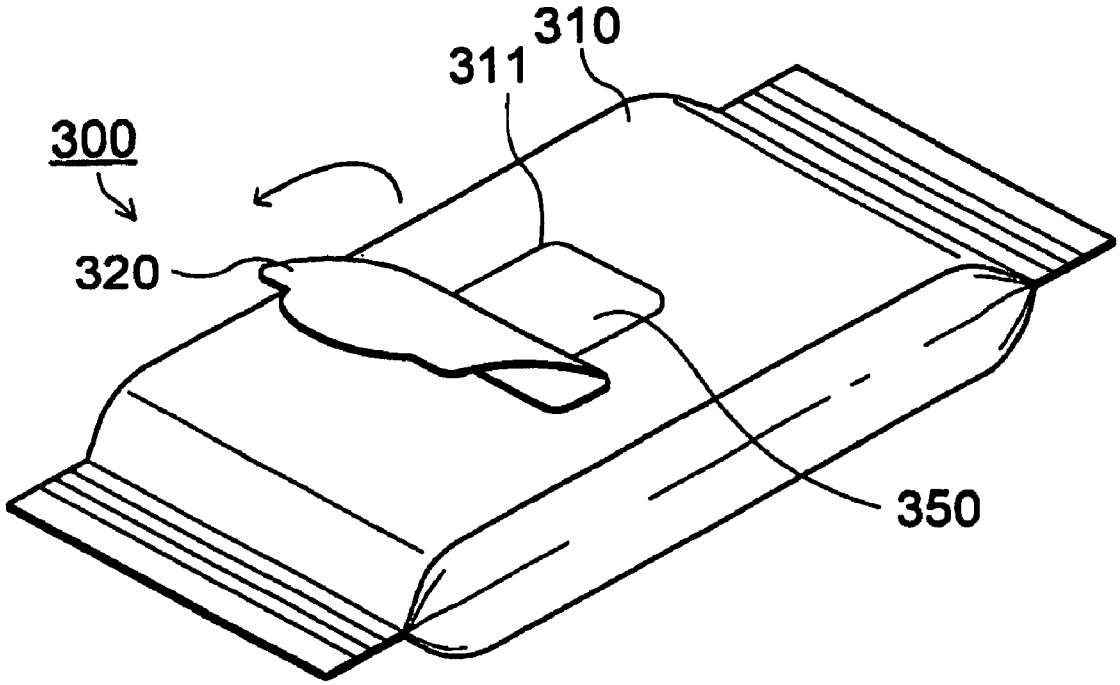
Fig. 15 (PRIOR ART)
FIG. 15 is a perspective view representing a state in which the lid member is peeled in FIG. 14.

FIGS. 12 and 13 represent a second embodiment of the package according to this invention. As shown in FIG. 12, this package 200 is similar to the first embodiment in that it is also a pillow-shaped package comprising the film 210, but different from the first one in that the tongue piece parts 221*a* and 221*b* are formed on the both sides of the lid member 220, and, in accordance to this arrangement, the cut line 211 forms in a substantially rectangular closed shape, and, furthermore, three respective dashed lines 212*a* and 212*b* are formed such that the protruding directions of their arcs are opposite each other.

<Function>

In this case, at the time of unsealing, as shown in FIG. 13, the lid member may be peeled either from the tongue piece part 221*b* side or, to the contrary, from the tongue piece part 221*a* side to form the opened portion 210*a*.

Since the package 200 can be thereby unsealed and/or re-sealed from either side, left or right, it is unnecessary to consider the unsealing direction so as to enable to provide more excellent package for unsealing.

The present invention can be preferably used as an easy-open package from which the stored contents can be readily taken out.

What is claimed is:

1. A package comprising:

a filmy soft packaging material, the soft packaging material provided with a cut line so as to form an openable region for taking the contents out of the package;

a lid member having a first tongue piece, which can be peeled from the soft packaging material, for adhering to the surface of the soft packaging material to cover the openable region; and a weakened portion inside the cut line, provided within the openable region of the soft packaging material and formed by means of weakening processing;

wherein the weakened portion comprises a dashed line separated from the cut line formed so as to cross a peeling direction of the lid member and serves as an operating point for the openable region so that the openable region becomes stepwise bended when the lid member is peeled.

2. The package according to claim 1, wherein the dashed line is formed perpendicular to the peeling direction of the lid member.

3. The package according to claim 1, wherein the dashed line is formed in a curve shape or a V letter shape protruding to the peeling direction of the lid member.

4. The package according to claim 2, wherein the dashed line is formed in a curve shape, or a V letter shape protruding, to the peeling direction of the lid member.

5. The package according to claim 1, wherein the dashed line is provided in a plurality thereof with predetermined intervals between them.

6. The package according to claim 2, wherein the dashed line is provided in a plurality thereof with predetermined intervals between them.

7. The package according to claim 3, wherein the dashed line is provided in a plurality thereof with predetermined intervals between them.

8. The package according to claim 4, wherein the dashed line is provided in a plurality thereof with predetermined intervals between.

9. The package according to claim 1, wherein the weakened portion is surrounded by the cut line.

10. The package according to claim 9, further comprising a second tongue piece, the first and second tongue pieces being respectively provided at opposing ends of the lid member.

11. A package comprising:

a filmy soft packaging material, the soft packaging material provided with a cut line so as to form an openable region for taking the contents out of the package, the openable region having a length of between 40 mm and 60 mm and having a width between 5 mm and 20 mm;

a lid member having a tongue piece, which can be peeled from the soft packaging material, for adhering to the surface of the soft packaging material to cover the openable region; and a weakened portion inside the cut line, provided within the openable region of the soft packaging material and formed by means of weakening processing;

wherein the weakened portion comprises a dashed line separated from the cut line formed so as to cross a peeling direction of the lid member and serves as an operating point for the openable region so that the openable region becomes stepwise bended when the lid member is peeled.

* * * * *